United States Patent [19]

Mondshine

[11] 4,040,866

[45] Aug. 9, 1977

[54] LAUNDERING OF OIL BASE MUD CUTTINGS

[75] Inventor: Thomas C. Mondshine, Houston, Tex.

[73] Assignee: N L Industries, Inc., New York, N.Y.

[21] Appl. No.: 649,553

[22] Filed: Jan. 15, 1976

Related U.S. Application Data

[63] Continuation-in-part of Ser. No. 404,000, Oct. 5, 1973, abandoned.

[51] Int. Cl.[2] ..... B08B 7/00

[52] U.S. Cl. ..... 134/26; 134/2; 134/40; 175/66; 175/206; 252/8.5 R

[58] Field of Search ..... 134/40, 26; 252/60, 252/170, 364, 327, 8.5 R, 8.5 M, 8.55 R, 8.55 B; 175/58, 66, 206; 166/305 R; 208/8, 11; 73/153

[56] References Cited

U.S. PATENT DOCUMENTS

| | | | |
|---|---|---|---|
| 3,131,759 | 5/1964 | Slusser et al. | 166/305 R |
| 3,254,718 | 6/1966 | Dunlap | 166/307 |
| 3,688,781 | 9/1972 | Talley | 134/56 R |
| 3,693,733 | 9/1972 | Teague | 175/66 |

OTHER PUBLICATIONS

Frick, Petroleum Production Handbook, vol. II, "Reservoir Engineering," 1962, pp. 23–26.

Stearns et al., *Baroid News Bulletin,* "A Neat Solution to Nordzee Polution," 1972, pp. 10–15.

Oil and Gas Journal, "Cuttings Can Meet Offshore Environment Specifications," Aug. 14, 1972, pp. 73–76.

*Primary Examiner*—Herbert B. Guynn

[57] ABSTRACT

A process for removing oil base mud adhering to cuttings obtained in well drilling operations, comprising contacting the cuttings with a solvent consisting essentially of a mixture of ethyleneglycol monoisobutyl ether, diethyleneglycol monobutyl ether acetate, ethyl butyl ketone, ethyleneglycol monobutyl ether, ethyleneglycol monomethyl ether acetate, diethyleneglycol diethyl ether, and diethyleneglycol mono-n-hexyl ether, together with paraffin oil, in relative proportions of from 10:90 to 80:20. This forms a mixture of oil and solvent on the cuttings which is readily removable; as by washing or centrifuging or a combination of the two.

6 Claims, 1 Drawing Figure

LAUNDERING OF OIL BASE MUD CUTTINGS

Figure 1:
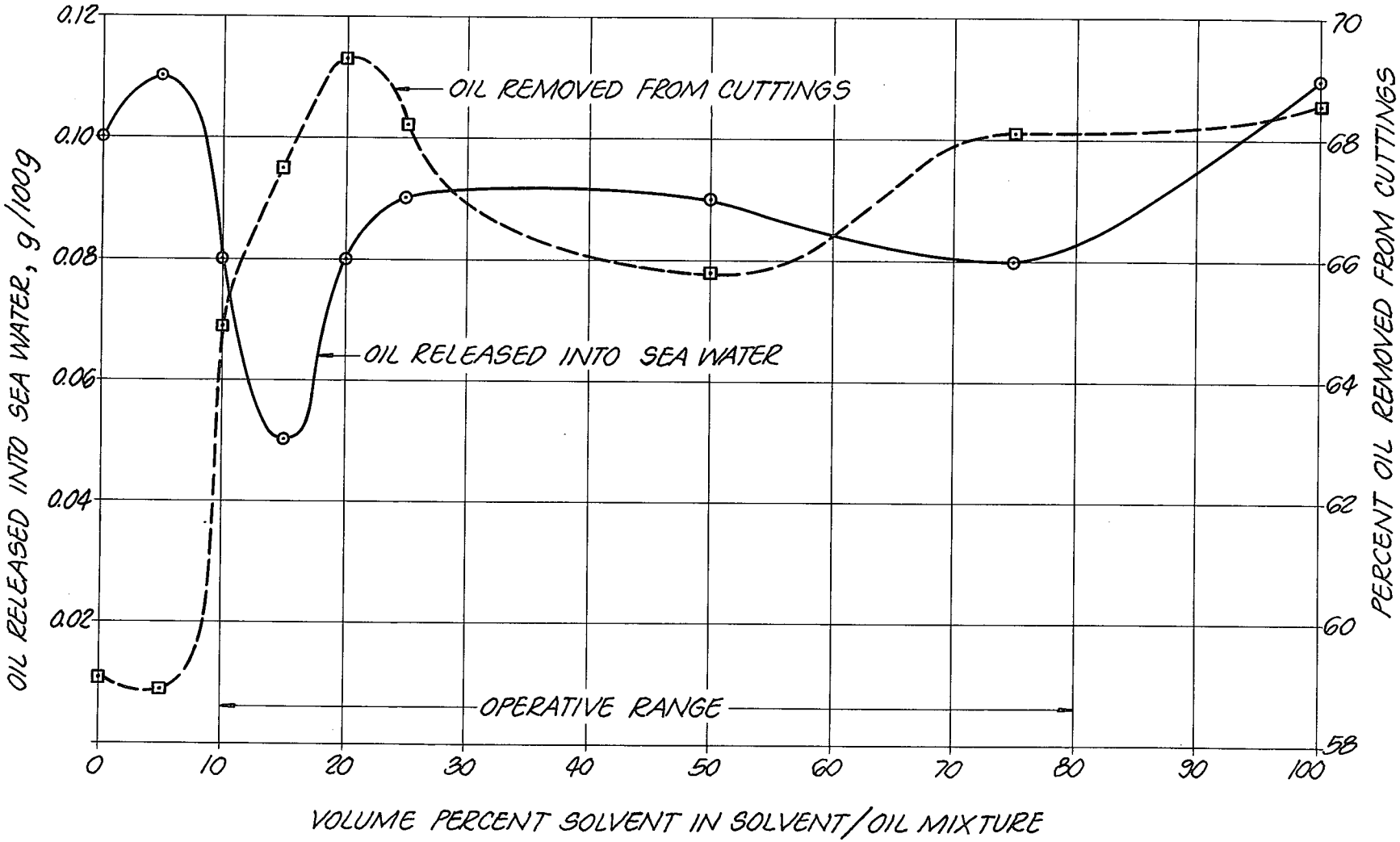

This application is a continuation-in-part of my copending application Ser. No. 404,000, filed Oct. 5, 1973, now abandoned.

This invention relates to the art of laundering cuttings obtained during drilling operations using oil base muds.

In the rotary method of drilling oil and gas wells, which is the only kind of drilling currently used in offshore installations, the cuttings dislodged by the bit are brought to the surface by a fluid medium termed "a mud" which may be a water base or an oil base mud. The latter type is frequently used, so that the cuttings as brought to the surface are effectively soaked and coated with the oil base mud. This entails a disposal problem, since the cuttings cannot be simply dumped into the ocean because of the oil pollution which this would bring about. One solution is to burn the oil from the cuttings, as shown for example in U.S. Pat. No. 3,693,951, to Lawhon et al. This patent discusses the oil coated cuttings disposal problem in some detail, and its teachings are incorporated herein by reference.

The usual mud handling surface equipment includes a means of screening cuttings from the mud so that the latter may be reused in the drilling operation. It would be desirable to provide a mechanical treatment of the cuttings which would be compatible with the screening installations already present on the usual offshore drilling rig, and which would not entail some of the disadvantages involved in burning off the oil from the cuttings. In particular, a procedure by which the oil could simply be flushed from the cuttings and recovered would have obvious advantages.

An object of the present invention is to provide a process for removing oil from drill cuttings whereby the oil can be recovered.

Another object of the invention is to provide a solvent having special properties for cuttings oil removal.

Other objects of the invention will appear as the description thereof proceeds.

In the drawings, FIG. 1 shows the oil stripping efficacy of my invention.

Generally speaking, and in accordance with illustrative embodiments of my invention, I treat cuttings coated with oil as a result of contact with oil base drilling mud by spraying or otherwise intimately contacting the cuttings with a mixture of a solvent consisting essentially of ethyleneglycol monoisobutyl ether, diethyleneglycol monobutyl ether acetate, ethyl butyl ketone, ethyleneglycol monobutyl ether, ethyleneglycol monomethyl ether acetate, diethyleneglycol diethyl ether, and diethyleneglycol mono-n-hexyl ether, and mixtures thereof in any proportion, together with a paraffin oil, the relative proportions of said solvent and said oil being within the range of about 10:90 to 80:20 by volume. This has the effect of forming a mixture of oil and solvent on the cuttings, which facilitates loosening the oil from the cuttings, all of the named solvents and mixtures thereof having some oil solubility. Next, the mixture of oil and solvent is removed from the cuttings. This can be done by centrifuging, but in the ordinary case, simple washing with water and more particularly with sea water suffices to bring about a separation of the oil-solvent mixture from the cuttings. The washing may be expedited by simultaneous centrifuging. Finally, the oil-solvent mixture is recovered, and may be reused.

The oil comprising the fluid phase of oil base drilling muds is a paraffin oil, generally diesel oil, heavy kerosene such as jet fuel, or in some cases, topped crude oil, and mixtures of these. As mentioned, the solvents listed hereinabove have some solubility in oil, but the action underlying their effectiveness goes much farther than simple solubility, since like results cannot be obtained by substituting kerosene, for example, for the inventive solvent-oil mixture. The particular solvents which I used appear to have a specific behavior at the oil-mineral interface where the oil occurs adhered to the cuttings surface. A further important advantage residing in my invention is that the mixture of oil and solvent readily separates out from sea water or from fresh water, so that when the treated cuttings are sprayed or washed with water or sea water, no complicated procedure is required to recover the solvent-oil mixture; it simply floats to the top and can be skimmed or pumped off.

The inventive solvent or solvent mixture is still operable even if it contains as much as 90% by volume of oil, which may consist of the oil obtained from the cuttings, or may consist of diesel oil or similar paraffin oil added to the solvent or solvent mixture. Thus, one may commence with a solvent-oil mixture containing as much as 80% by volume of solvent and continue operations, recycling the solvent-oil mixture as it accumulates from the cuttings washing operation, until the oil content reaches about 90% by volume. Additional solvent may then be added to maintain the efficiency of the mixture. Eventually, when the total volume of solvent-oil mixture becomes inconveniently large, the solvents can be recovered therefrom by distillation, using the ordinary procedures for solvent recovery. The oil remaining after removal of the solvent has substantial economic value, and may be used for the preparation of oil base drilling muds. Since the continuous removal of oil adhering to cuttings represents a loss in the total oil volume of the oil base mud on a particular drilling rig, the recovered oil freed of its solvent can of course simply be recycled into the oil base drilling mud system from whence it came. As explained more fully below, solvent:oil mixtures anywhere within the relative proportions of 10:90 to 80:20 by volume may be used.

It will be clear from the description of the invention that no one type of mechanical installation need be employed. A suitable mechanical arrangement is shown in the article appearing on pages 73–76 of the *Oil and Gas Journal,* Aug. 14, 1972, entitled "Cuttings Can Meet Offshore Environmental Specifications", the contents of which are hereby included herein by reference. The invention may also be used in the apparatus shown and described in U.S. Pat. Nos. 3,688,781 to Talley, Jr; and 3,693,733, to Teague, both of these patents being included herein by reference.

As an example of my invention, and also in order to show the basis for the range of relative proportions of organic solvent and paraffin oil already set forth, the following exemplary tests will be described.

A series of solvent/oil mixtures were prepared using ethyleneglycol monoisobutyl ether as the solvent and diesel oil as the paraffin oil, in varying proportions including both 0% and 100% solvent. Cuttings obtained from an actual well drilling operation were placed in a container with an excess of a typical oil base mud, known commercially as an Invermul/Duratone HT oil base mud. The container was closed and rotated about its longitudinal axis for 1 hour at 65° C. The excess oil base mud was then removed by screening with a 10 mesh screen. The cuttings were then placed in a jar and allowed to stand overnight. Two 100g portions of the cuttings and 200cc of a selected solvent/oil mixture as described above were placed in a jar, hand shaken for 30 seconds, and emptied onto a 10 mesh screen. The screened cuttings were then placed in a jar and washed with three individual 100cc portions of synthetic sea water with hand shaking for 20 seconds each. After each wash, the wash solution was decanted and discarded. The cuttings after the last wash were then collected on a 10 mesh screen, weighed, and a retort analysis obtained on a weighed portion of the washed cuttings.

To another portion of each sample of the washed cuttings as described above 450cc of synthetic sea water were added and the mixture allowed to stand for 64 hours in a jar. At the end of that time, the sea water was carefully decanted from the cuttings, placed in a separatory funnel, and extracted with 10cc of hexane. The hexane was then collected in a graduated centrifuge tube and evaporated off using a hot water bath. The oil residue remaining was measured and calculated as the weight of oil per unit weight of washed cuttings.

The results obtained are shown in Table 1 which follows, and have also been plotted in the form of a graph in FIG. 1.

Table 1

| Wash Solvent | Oil Removed from Cuttings | Oil Removed |
|---|---|---|
| % by Volume of Ethylene Glycol Monoisobutyl Ether in Diesel Oil | % by Weight of Total Oil | Into Sea Water After Aging Cuttings for 64 hr. g/100 g Cuttings |
| 100 | 68.6 | 0.11 |
| 75 | 68.1 | 0.08 |
| 50 | 65.8 | 0.09 |
| 25 | 68.2 | 0.09 |
| 20 | 69.3 | 0.08 |
| 15 | 67.5 | 0.05 |
| 10 | 64.9 | 0.08 |
| 5 | 58.9 | 0.11 |
| 0 | 59.1 | 0.10 |

As may be seen from FIG. 1, the inventive operative range extending from 10% to 80% solvent in the solvent:paraffin oil mixture avoids the excessive amount of oil which would be released into the sea water if a smaller amount of solvent were present, for example, 5%; and at the other end of the range it avoids the increased amount of oil released into the sea water where substantially more than 80% solvent is present, all as shown by the solid line on FIG. 1. Likewise, amounts of solvent less than 10% lead of a very low removal of oil from the cuttings, as shown by the dashed line on FIG. 1.

I wish it to be understood that I do not desire to be limited to the exact details of procedure described herein, for obvious modifications will occur to a person skilled in the art.

Having described the invention, I claim:

1. The method of removing oil adhering as a coating to drilled well cuttings obtained during the course of drilling which comprises the steps of intimately contacting said cuttings with a mixture of a solvent selected from the group consisting of ethyleneglycol monoisobutyl ether, diethyleneglycol monobutyl ether acetate, ethyl butyl ketone, ethyleneglycol monobutyl ether, ethyleneglycol monomethyl ether acetate, diethyleneglycol diethyl ether, and diethyleneglycol mono-n-hexyl ether and mixtures thereof in any proportion, together with a paraffin oil, the relative proportions of said solvent and said oil being within the range of about 10:90 to 80:20 by volume, so as to form a mixture of oil and said solvent on said cuttings; and thereafter removing said oil-solvent from said cuttings by washing said contacted cuttings with water.

2. The process in accordance with claim 1 wherein said water is sea water.

3. The process in accordance with claim 1 wherein said removal is accomplished by centrifuging.

4. The process in accordance with claim 1 wherein said washing is expedited by centrifuging.

5. The process in accordance with claim 1 wherein said oil-solvent mixture is recovered from said water subsequent to said washing by decantation.

6. The process in accordance with claim 1 wherein said paraffin oil is selected from the group consisting of diesel oil, heavy kerosene, topped crude oil, and mixtures thereof.

* * * * *